United States Patent [19]

Haines et al.

[11] Patent Number: 4,943,718

[45] Date of Patent: Jul. 24, 1990

[54] MASS SPECTROMETER

[75] Inventors: Raymond C. Haines, Kelsall; Patrick J. Turner, Wilmslow, both of United Kingdom

[73] Assignee: VG Instruments Group Limited, Crawley, England

[21] Appl. No.: 312,632

[22] Filed: Feb. 17, 1989

[30] Foreign Application Priority Data

Feb. 18, 1988 [GB] United Kingdom ..... 8803837

[51] Int. Cl.[5] ..... H01J 49/14

[52] U.S. Cl. ..... 250/288; 250/298; 250/299; 250/423 R; 250/427; 313/359.1; 313/363.1; 313/362.1; 313/230

[58] Field of Search ..... 250/288, 298, 299, 423 R, 250/427; 313/230, 359.1, 363.1, 362.1, 230 X

[56] References Cited

U.S. PATENT DOCUMENTS

| | | | |
|---|---|---|---|
| 2,831,134 | 4/1958 | Reifenschweiler | 313/363.1 |
| 2,945,951 | 7/1960 | Bright | 313/230 |
| 3,286,187 | 11/1966 | Gabor | 313/230 |
| 3,315,125 | 4/1967 | Frölich | 313/230 |
| 3,641,339 | 2/1972 | McCormick | 250/298 |
| 4,078,176 | 3/1978 | Matsuda | 250/299 |
| 4,134,013 | 1/1979 | Evans et al. | 250/298 |
| 4,816,685 | 3/1989 | Lange | 250/288 |

OTHER PUBLICATIONS

Biddle et al, "Integrated development facility for the calibration of low energy charge particle flight instrumentation", Rev. Sci. Instrum. 1986, 57(4), pp. 572–582.
Ghielmetti et al, "Calibration system for satellite and rocket-borne ion mass spectrometer . . ", Rev. Sci. Instrum., 1983, 54(4), pp. 425–536.
Coggeshall, J. Chem. Phys. 1944, 12 (1), 19–23.
Schaeffer, J. Chem. Phys., 1950, 18, 1681–1682.
Hohenberg, Rev. Sci. Instrum. 1980, 51, (8), 1075–1082.
Mel'tsina et al, Sov. Phys. Tech. Phys., 1976, 21 (6), 759–760.
Belousov, Zh. Anal. Khim. 1985, 40 (6), 990–995.
Werner, J. Phys. E., 1974, 7 (2), 15–21.
Mark, in Electron Impact Ionization, Ed. Mark. Dunn, Pub: Springer-Verlag, Wein, N.Y., 1985, 30 (10).
Berry, Phys. Rev. 1950, 76 (5), 597–605.
Belousov, Muranev, et al, Sov. Phys. Tech. Phys. 1985, 30 (10), 1165–1167.
Drewitz, Taubert, Int. J. Mass Spectrom. and Ion Phys, 1976, 19 (3), 293–312.
Werner, Int. J. Mass Spectrom. and Ion Phys, 1974, 14 (2), 189–203.
Mark, Beitr. Plasmaphysik, 1982, 22, pp. 257–294.

*Primary Examiner*—Janice A. Howell
*Assistant Examiner*—Kiet T. Nguyen
*Attorney, Agent, or Firm*—Chilton, Alix & Van Kirk

[57] ABSTRACT

The invention provides a mass spectrometer comprising an ion source provided with an electron emitting source and magnets which are cooperable to produce a collimated electron beam within the ion source; a mass analyzer; first and second electrodes which cooperate to limit the angular divergence of the ion beam which emerges from the source along the ion beam axis; and magnetic field screens disposed between the first and second electrode means, which reduce the field due to the magnets along the ion beam axis. In this way the mass discrimination introduced by the magnets in prior ion sources is reduced and the accuracy of isotropic ratio measurements is improved.

20 Claims, 2 Drawing Sheets

31
27
34
33
32
16
40
15
30
37
34
11
43
9
4
13
26
5
3
6
7
1
22
24
38
23
21
39
25
28
36
36
41
29
35

MASS SPECTROMETER

This invention relates to a mass spectrometer having an electron impact ion source, and in particular to such a spectrometer adapted for the isotopic analysis of gaseous samples.

Mass spectrometers having electron impact ionization sources for gas analysis are well known. The most common type, known as a Nier source, comprises an ionization region of substantially constant electrostatic potential defined by an electrically conducting grid or solid wall. Sample molecules introduced into this region are ionized by collision with electrons comprised in a beam which passes through the region. Sample ions are extracted from the region through an aperture in an ion-extraction electrode by means of a weak electrostatic field established between that electrode an ion-repeller electrode located in the region and are subsequently accelerated to a desired kinetic energy by a strong electrostatic field established between the ion-extraction electrode and a "source-slit" electrode disposed between the ion-extractor electrode and the mass analyzer.

In such an ion source it is conventional to provide a magnetic field aligned with the axis of the electron beam in order to collimate that beam and increase the number of electrons which can effectively ionize sample molecules, thereby increasing the sensitivity of the spectrometer. It is also conventional to limit the angular spread of the ion beam produced by the source by means of a beam collimator comprising a pair of electrodes. Typically, one of these electrodes is the source-slit electrode and the other (known as an $\alpha$-slit electrode) is disposed between the source-slit electrode and the mass analyzer.

Unfortunately, such spectrometers suffer from mass discrimination effects which result in the spectrometer exhibiting different sensitivities for ions of different mass-to-charge ratios. The problem is particularly acute when accurate isotope ratio measurements are required, and has been so for many years. See, for example, Coggeshall, J. Chem. Phys, 1944, vol 12(1) pp 19–22, Schaeffer, J. Chem. Phys, 1950, vol 18, pp 1681–2, Schulz, Drost, and Klotz, Exp. Tech. Phys. 1968, vol 16(1) pp 16–22, and Hohenberg, Rev. Sci. Instrum, 1980, vol 51(8) pp 1075–82.

The problem of mass discrimination has been very extensively investigated and several different causes have been established. One of the most intractable is the effect of a magnetic field on the ion source, whether due to the fringing field of an adjacent magnetic sector mass analyzer or to the field provided in the ionization region to collimate the electron beam. Such a field causes different ions to be deflected by different amounts from their proper trajectories so that some ions which would otherwise be transmitted are lost at a subsequently located slit. Although Werner (J. Phys. E, 1974, vol 7(2) pp 15–21) claims that the effect of the source magnetic field is negligible in comparison with other factors, this is not the case with isotope-ratio mass spectrometers and Hohenberg (see above) recommends the use of a Baur-Signer source (which does not use a magnetic field) in order to overcome the problem. Unfortunately, Baur-Signer sources are not as sensitive as current Nier-type sources, and are in any case more complicated and more expensive to produce.

In the case of mass discrimination resulting from the fringing field of a mass analyzing magnet, several workers have suggested that the effect can be reduced by fitting magnetic screens around the source or, in the case of a spectrometer for analyzing solid samples by laser bombardment, etc, along the entire ion optical axis from the sample surface to the magnetic sector analyzer. See, for example, Mel'tsina, Nechaeva and Tsymberov. Sov. Phys. Tech. Phys. 1976 vol 21(6) pp 759–60 and Belousov, Zhurnal Anal. Khim, 1985, vol 40(6) pp 990–5. However, this approach is obviously not applicable as a means of reducing the discrimination caused by the source magnets themselves, because the magnetic field they produce is an essential component of the ion source.

It is the object of the present invention to provide a mass spectrometer having an ion source, for example a Nier-type ion source, in which ion generation is effected by a magnetically collimated electron beam, which spectrometer exhibits an improved performance in comparison with prior types, especially in respect of the mass discrimination due to the magnets fitted in its source.

In accordance with this objective there is provided a mass spectrometer comprising:

(a) an ion source provided with an electron emission source and magnet means which are cooperable to produce an electron beam in said ion source;

(b) a mass analyzer;

(c) first and second electrode means disposed about the ion optical axis between said electron beam and said mass analyzer and cooperable to limit the angular divergence of the ion beam produced by said ion source; and (d) magnetic field screening means disposed to substantially reduce the magnetic field due to said magnet means along at least a part of the ion-optical axis between said first and said second electrode means.

Preferably the first electrode means is disposed between the electron beam and the second electrode means and the magnetic field screening means is disposed at or adjacent the first electrode means. Conveniently the first electrode means comprises the source-slit electrode which defines the end of the electrostatic field provided for accelerating the ions from the ion source. Typically, the source-slit electrode may also be used to define the cross-section of the ion beam passing through it.

In a further preferred embodiment the magnetic field screening means is further disposed to reduce the magnetic field due to the magnet means along at least a part of the ion-optical axis between the electron beam and the first electrode means.

In this way the invention results in a substantial reduction in the mass discrimination at the second electrode means (i.e, the $\alpha$-slit). It is most effective in achieving this when the magnetic field screening means is disposed to reduce the field in the vicinity of the first electrode means (typically the source-slit) because in this position it minimizes the change in angle between the ion optical axis and the trajectories of particular ions which is caused by the magnetic field, reducing the subsequent loss of ions whose trajectories are at too great an angle to pass through the $\alpha$-slit. If the screening means is further disposed to reduce the magnetic field between the electron beam and the first electrode means (i.e, the source-slit), then mass discrimination at this slit may also be reduced.

In a preferred embodiment the magnetic field screening means comprises an elongate passage formed in a ferromagnetic material through which the ion beam passes to the mass analyzer. Conveniently this may commence at the source-slit electrode and extend towards the α-slit, and may also comprise the source-slit electrode itself.

In an alternative preferred embodiment, the magnetic field screening means comprises a plate-like member of ferromagnetic material which extends in a plane perpendicular to the ion axis and is provided with an aperture through which ions pass to the mass analyzer. In this embodiment, the magnetic field is substantially reduced on the side of the screening means remote from the magnet means by virtue of the shunting effect of the screening means.

In this way it has surprisingly been found that the mass discrimination caused by the magnet means in the source can be substantially reduced, if not completely eliminated, while the advantages of the magnetically collimated electron beam in the ionizing region are maintained. Clearly, the shunting effect of the screening means will reduce the effectiveness of such collimation if the screening means extends too close to the electron beam, but the inventors have found that the location of the screening means is not especially critical and the correct position can easily be found by experiment for any particular ion source. If it commences too close to the electron beam, difficulty will be experienced in obtaining a stable collimated electron beam, and if it commences too far away, the mass discrimination effects will not be substantially reduced.

Magnetic field screening means may also be provided between the ion-extraction electrode of the ion source and the source-slit electrode, for example in the form of one or more short sections, typically short tubes, of ferromagnetic material disposed between the electrodes as required. These sections are conveniently maintained at suitable electrical potentials, selected to avoid interference with the electrostatic field present in this region. Additionally or alternatively, the electrodes themselves may be adapted to provide magnetic screening. Because the magnetic field which causes the mass discrimination is parallel to the electron beam it is permissible for the screening means to incorporate a small gap parallel to this axis without significantly detracting from its effectiveness. This allows the "half-plate" electrodes conventionally used for steering the ion beam along the mass dispersion axis to be adapted to provide magnetic screening if desired.

Preferably the magnetic field screening means are fabricated from a low-remanance ferromagnetic material such as soft irOn. The type known as "Low Moor" iron is particularly suitable.

If an elongated magnetic field screening means is provided it should preferably extend along the ion optical axis to a point at which the field from the magnet means (in the absence of the screens) is low enough to have no significant effect, but which is far enough from the mass analyzing magnetic field (if provided) to avoid the screening means interfering with the uniformity of that field. In most practical spectrometers this is easily achieved because of the distance between the ion source and the analyzing magnet. For a typical 12 cm or 18 cm radius magnetic sector analyzer, with a conventional gas analyzing Nier source, the mass discrimination due to the source magnets is substantially eliminated by a screening means which extends some 5 or 6 cm towards the mass analyzer from the source-slit electrode. However, it will be appreciated that advantage can be gained from the use of a much shorter screening means, even if it does not completely eliminate the mass discrimination.

The invention will now be described in greater detail bY way of example only and with reference to the figures, in which.

Figure 2:
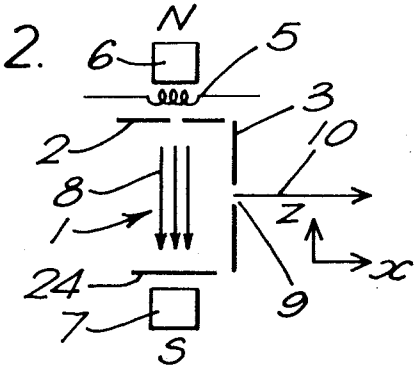
FIG. 2 is a schematic drawing of the ion source of the spectrometer of FIG. 1 viewed along a different axis; and, FIG. 3 is a sectional drawing of an ion source suitable for use in the spectrometer of FIG. 1.

Referring to the figures, a sample to be ionized is introduced into an ionization region 1 which is defined in part by an electron-entrance electrode 2 and an ion-extraction electrode 3. Electron-entrance electrode 2 comprises an aperture 4 through which electrons emitted by a heatable filament 5 enter ionization region 1. Magnet means 6 and 7, comprising a pair of cylindrical permanent magnets disposed as shown in FIG. 2, generate an axial magnetic field 8 which collimates the electrons in beam 33 (FIG. 3) in the ionization region 1.

At least some of the sample molecules present in ionization region 1 are ionized by the electrons in beam 33, and some of the ions so produced leave in the form of an ion beam aligned with the ion-beam axis 10 through an aperture 9 in the ion-extraction electrode 3. An ion-accelerating electrostatic field is provided between ion-extraction electrode 3, which is maintained at a high potential by an accelerating voltage power supply 12, and a source-slit electrode 11 (i.e, the first electrode means of the invention), which is grounded. The ion-accelerating field also penetrates into ionization region 1 and increases the efficiency of ion extraction through aperture 9. The angle of divergence of the ion beam travelling along axis 10 is limited by the collimating action of the source-slit electrode 11 and the α-slit 44 (i.e, the second electrode means of the invention).

Figure 1:
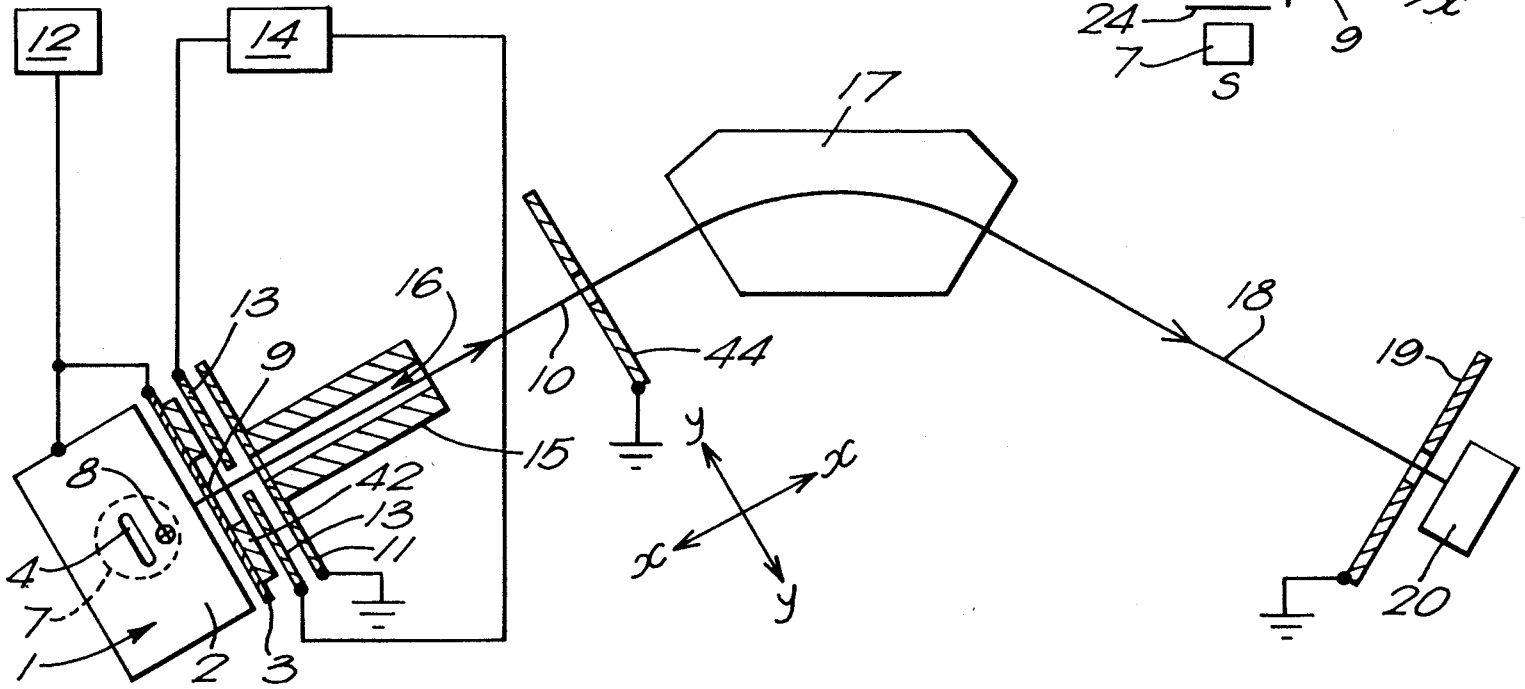
FIG. 1 is a schematic drawing of a mass spectrometer according to the invention.

A pair of half-plate electrodes 13 are provided between electrodes 3 and 11 as shown in FIG. 1. The average potential on these is maintained at a value intermediate between that of electrodes 3 and 11 by means of adjustable power supply 14, which also provides a small adjustable differential potential between the two plates comprising the pair. This allows accurate steering of the ion beam along the y axis (as defined in the inset to FIG. 1).

Magnetic field screening means 15, comprising a shaped block of ferromagnetic material, e.g, "Low Moor" iron, is fitted adjacent to source-slit electrode 11 as shown. It provides an elongated passage 16 aligned with the ion beam axis 10 through which the ions travel towards the magnetic sector mass analyzer 17, and is adapted to substantially reduce the magnetic field along the ion axis 10 between the source-slit electrode 11 and the α-slit 44. Ions of a selected m/e ratiO leave mass analyzer 17 along axis 18 and pass through a collector slit 19, to be detected by an ion detector 20 in a conventional way.

Figure 3:
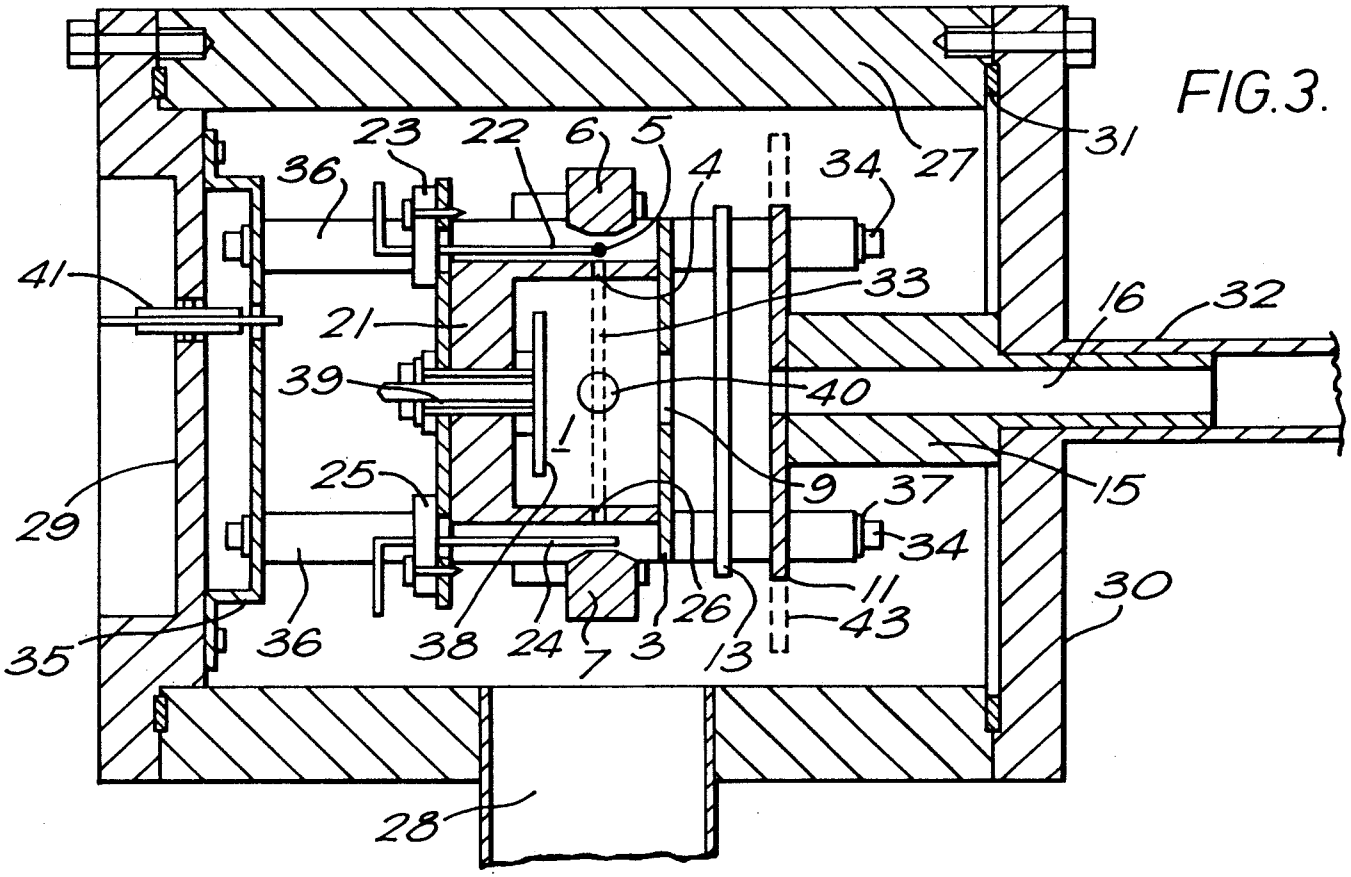

Referring next to FIG. 3, a vacuum-tight cylindrical housing 27 is fabricated from stainless steel and is provided with an evacuation port 28. The ends of housing 27 are closed by a source mounting flange 29, and a flight tube mounting flange 30 both of which are sealed to housing 27 by means of copper gaskets (e.g. 31). A flight-tube 32, which passes between the poles of the mass analyzing magnet (17, FIG. 1) is attached to flange 30 as shown. An α-slit electrode 44 (not shown in FIG. 3) is fitted inside flight tube 32. Ionization region 1 comprises a rectangular recess in an ionization block 21, one wall of which comprises the electron-entrance electrode 2. The recess is closed by ion-extraction electrode 3 which comprises a thin plate in which aperture 9 is formed, as shown. A heatable filament 5 is welded on two filament supports 22 which are moulded in an insulated filament-support block 23. An electron trap electrode 24 is similarly supported from insulated block 25 and an aperture 26 is provided in the wall of block 21 opposite to aperture 4 to allow electron beam 33 to impinge on trap electrode 24. The current passed through filament 5 is controlled by a regulator (not shown) which receives a control signal dependent on the current flowing from electrode 24 in order to maintain the electron current in beam 33 substantially constant.

Ionization block 21 is supported on four ceramic rods 34 from a mounting bracket 35 secured to flange 29. Tubular ceramic insulators 36 are used to space block 21 from bracket 35 as shown. Half-plate electrodes 13 and source-slit electrode 11 are also supported on rods 34 and are spaced apart as shown by tubular insulators. Circlips (e.g. 37) which locate in grooves cut in rods 34 are used to secure the complete ion source assembly. Electrical connections to the source electrodes are made through feedthroughs 41 mounted through flange 29 as shown.

An ion-repeller electrode 38 is mounted inside ionization block 21 and ionization region 1 by means of an insulated feedthrough assembly 39. It is maintained at an adjustable potential close to the potential of chamber 21 and is used to vary the extraction field inside region 1 as in a conventional Nier source.

Two holes 40 are provided in the walls of block 21 in order to allow sample gas introduced into housing 27 to enter the ionization region 1.

Magnetic collimation of the electron beam 33 is provided by magnet means 6 and 7, comprising two cylindrical permanent magnets mounted in clamps attached to the exterior of block 21. These are disposed with the polarities indicated in FIG. 2 and provide a magnetic field 8 (FIGS. 1 and 2) which is substantially aligned with electron beam 33.

A magnetic field screening means 15 made of ferromagnetic material is disposed between the source-slit electrode 11 and the flight-tube 32 as shown in FIG. 3 and comprises a substantially cylindrical rod of soft iron containing a elongated passage 16 through which the ions pass into the flight-tube 32. The end of the screening means remote from electrode 11 is shaped to fit into the flight-tube 32 as shown in FIG. 1, and the screening means is maintained in position by light pressure exerted on it by electrode 11, which is grounded. Screening means 15 is maintained at ground potential by virtue of its contact with electrode 11 and flight tube 32.

If additional (or alternative) screening is provided between electrodes 3 and 11, this may comprise for example ferromagnetic screening sections mounted on rods 34 disposed between the electrodes. These sections, typically rings of ferromagnetic material, may be combined with the electrodes themselves if desired, for example as shown at 42 in FIG. 1. Obviously, screening sections in this region must be maintained at a potential appropriate to their position in the electrostatic field which exists between electrodes 3 and 11.

In the case of a spectrometer according to the invention in which the magnetic field screening means comprises a plate-like member, this may conveniently be provided by fitting a ferromagnetic screening plate at an appropriate position on rods 34, or by extending one of the electrodes at least in the direction of the electron axis. For example, source-slit electrode 11 may comprise a plate-like member of ferromagnetic material about 1–2 mm thick and may extend as indicated at 43 (FIG. 3). However, the aperture through which the ions pass should preferably be formed in thin material spot welded over a larger hole in the electrode itself. Such a construction is commonly employed in making thin lens electrodes for use in mass spectrometers.

What is claimed is:

1. A mass spectrometer comprising:

(a) an ion source for producing a beam of ions, the ion beam having an ion-optical axis, said ion source being provided with an electron emission source and magnet means which are cooperable to produce an electron beam within said ion source, the electron beam having an axis;

(b) a mass analyzer;

(c) first and second electrode means disposed about the ion-optical axis between said electron beam axis and said mass analyzer and cooperable to limit the angular divergence of the ion beam produced by said ion source; and (d) magnetic field screening means disposed to reduce substantially the magnetic field due to said magnet means along at least a part of the ion-optical axis between said first and said second electrode means.

2. A mass spectrometer according to claim 1 in which said first electrode means is disposed between said electron beam axis and said second electrode means, and said magnetic field screening means is disposed at or adjacent said first electrode means.

3. A mass spectrometer according to claim 1 in which said first electrode means is disposed between said electron beam axis and said second electrode means, and said magnetic field screening means is further disposed to reduce the magnetic field due to said magnet means along at least a part of the ion-optical axis between the electron beam axis and the first electrode means.

4. A mass spectrometer according to claim 1 in which said magnetic field screening means comprises an elongate passage formed in ferromagnetic material, through which said ion beam passes.

5. A mass spectrometer according to claim 2 in which said magnetic field screening means comprises an elongate passage formed in ferromagnetic material, through which said ion beam passes.

6. A mass spectrometer according to claim 4 in which said first electrode means defines the end of an electrostatic field provided for accelerating ions from said ion source and in which said ferromagnetic material commences at said first electrode means and extends towards said second electrode means.

7. A mass spectrometer according to claim 5 in which said first electrode means defines the end of an electrostatic field provided for accelerating ions from said ion source and in which said ferromagnetic material commences at said first electrode means and extends towards said second electrode means.

8. A mass spectrometer according to claim 1 in which said magnetic field screening means comprises a plate-like member which extends in a plane perpendicular to said ion-optical axis and which is provided with an aperture through which ions pass to said mass analyzer.

9. A mass spectrometer according to claim 2 in which said magnetic field screening means comprises a plate-like member which extends in a plane perpendicular to said ion-optical axis and which is provided with an aperture through which ions pass to said mass analyzer.

10. A mass spectrometer according to claim 1 in which said magnetic field screening means extends towards said electron beam axis to a point beyond which a stabilized ionizing electron beam current of a selected magnitude cannot be maintained.

11. A mass spectrometer according to claim 3 in which said magnetic field screening means extends towards said electron beam axis to a point beyond which a stabilized ionizing electron beam current of a selected magnitude cannot be maintained.

12. A mass spectrometer according to claim 1 in which said first electrode means defines the end of an electrostatic field provided for accelerating ions from said ion source and in which said magnetic field screening means includes at least a first section comprised of ferromagnetic material, said first section being maintained at a selected electrical potential and disposed to reduce the magnetic field due to said magnet means in the region of said electrostatic field.

13. A mass spectrometer according to claim 3 in which said first electrode means defines the end of an electrostatic field provided for accelerating ions from said ion source and in which said magnetic field screening means includes at least a first section comprised of ferromagnetic material, said first section being maintained at a selected electrical potential and disposed to reduce the magnetic field due to said magnet means in the region of said electrostatic field.

14. A mass spectrometer according to claim 12 in which said screening means comprises a plurality of said sections and wherein at least some of said sections comprise electrodes for varying the trajectory of ions in the ion beam.

15. A mass spectrometer according to claim 13 in which said screening means comprises a plurality of said sections and wherein at least some of said sections comprise electrodes for varying the trajectory of ions in the ion beam.

16. A mass spectrometer according to claim 1 in which said magnetic field screening means is fabricated from a low-remanence ferromagnetic material.

17. A mass spectrometer according to claim 4 in which said magnetic field screening means is fabricated from a low-remanence ferromagnetic material.

18. A mass spectrometer according to claim 8 in which said magnetic field screening means is fabricated from a low-remanence ferromagnetic material.

19. A mass spectrometer according to claim 12 in which said magnetic field screening means is fabricated from a low-remanence ferromagnetic material.

20. A mass spectrometer according to claim 14 in which said electrodes are fabricated at least in part from a low remanence ferromagnetic material.

* * * * *